US007469728B2

(12) United States Patent
Murayama et al.

(10) Patent No.: US 7,469,728 B2
(45) Date of Patent: Dec. 30, 2008

(54) FLUID INJECTING DEVICE

(75) Inventors: Hiroshi Murayama, Ichinomiya (JP); Takenori Yanai, Konan (JP)

(73) Assignee: Murata Kikai Kabushiki Kaisha, Kyoto-shi (JP)

( * ) Notice: Subject to any disclaimer, the term of this patent is extended or adjusted under 35 U.S.C. 154(b) by 276 days.

(21) Appl. No.: 11/335,476

(22) Filed: Jan. 20, 2006

(65) Prior Publication Data

US 2006/0169353 A1 Aug. 3, 2006

(30) Foreign Application Priority Data

Jan. 31, 2005 (JP) ..... 2005-024550

(51) Int. Cl.
*B67C 3/26* (2006.01)

(52) U.S. Cl. ..... 141/279; 141/10; 141/94; 141/284; 141/314; 141/387

(58) Field of Classification Search ..... 141/10, 141/83, 94, 114, 266, 270, 279, 283, 284, 141/313–317, 352, 387; 383/3; 206/522
See application file for complete search history.

(56) References Cited

U.S. PATENT DOCUMENTS 4,905,835 A 3/1990 Pivert et al.
5,042,663 A 8/1991 Heinrich
5,454,642 A 10/1995 De Luca
5,901,850 A 5/1999 Jones et al.
6,561,236 B1 5/2003 Sperry et al.
6,877,533 B2 * 4/2005 Roskam ..... 141/114

FOREIGN PATENT DOCUMENTS

DE 38 13 309 A1 8/1989
JP 2002-154579 5/2002
WO WO 85/00151 1/1985

OTHER PUBLICATIONS

European Search Report dated May 10, 2006, issued in corresponding European Patent Application No. EP 05 02 7120.

* cited by examiner

*Primary Examiner*—Timothy L Maust
(74) *Attorney, Agent, or Firm*—Westerman, Hattori, Daniels & Adrian, LLP.

(57) ABSTRACT

A general-purpose fluid injecting device is provided that can be used if an air bag is accommodated in a box of a different height. A fluid injecting device is provided that injects a fluid into an air bag through a nozzle projecting from a box the air bag being housed in the box. The device includes a detection apparatus for detecting a height position of the nozzle and a control apparatus for varying the height position of fluid injecting device in accordance with the detection.

3 Claims, 12 Drawing Sheets

FLUID INJECTING DEVICE

FIELD OF THE INVENTION

The present invention relates to a fluid injecting device that injects a fluid from the outside of a box into an air bag accommodated in the box to inflate the air bag so as to allow the air bag to function as a cushioning material.

BACKGROUND OF THE INVENTION

A fluid injecting device is conventionally known which injects a fluid from the outside of a box into an air bag accommodated in the box to inflate the air bag (the Unexamined Japanese Patent Application Publication (Tokkai-Hei) No. 2002-154579). As shown in FIG. 14, the fluid injecting device has an article loading station 101, a banding station 102, and a fluid supply station 103 provided along a conveying line 100. An empty box 104 is conveyed from upstream of the article loading station 101. Then, in the article loading station 101, an article 105 is loaded into the box 104. Subsequently, as shown in FIG. 15, an air bag 107 is placed on the article 105; a nozzle 106 has been installed in the air bag 107. On this occasion, the air bag is installed so that the nozzle 106 projects out of the box 104.

Then, in the banding station 102, as shown in FIG. 16, a cover 108 is placed on the box 104 to close it. The box 104 is then tied with a band 109.

Then, in the fluid supply station 103, a fluid is injected into the air bag 107 through the nozzle 106 to inflate the air bag 107. The air bag 107 thus functions as a cushioning material in the box 104.

After the operation of injecting air into the air bag 107 is completed, the nozzle 106 is removed.

However, the prior art fluid injecting device can be used only if the nozzle is set at the same height in the box, that is, only if the box has the same height. Accordingly, the prior art fluid injecting device has poor general purpose properties. Thus, a fluid injecting device has been desired which is applicable to the case in which the air bag is accommodated in a box of a different height.

SUMMARY OF THE INVENTION

The present invention is made to solve the above problem of the prior art. It is thus an object of the present invention to provide a general-purpose fluid injecting device that can also be used if an air bag is accommodated in a box of a different height.

An aspect of the present invention set forth in Claim 1 provides a fluid injecting device that injects a fluid into an air bag through a nozzle projecting from a box, the air bag being housed in the box, the fluid injecting device being characterized by comprising means for detecting a height position of the nozzle, and control means for varying the height position of the fluid injecting means in accordance with the detection.

An aspect of the present invention set forth in Claim 2 provides the fluid injecting device according to Claim 1, characterized in that the nozzle height position detecting means comprises a sensor that detects a top surface of the box.

An aspect of the present invention set forth in Claim 3 provides the fluid injecting device according to Claim 2, characterized in that the injection of the fluid is ended in accordance with the detection carried out by the sensor.

According to the aspect of the present invention set forth in Claim 1, a fluid can be automatically injected into air bags housed in boxes of various sizes.

According to the aspect of the present invention set forth in Claim 2, not only the effects of the aspect of the present invention set forth in Claim 1 are provided but it is also possible to easily and reliably detect the height position of the nozzle set so as to project from the top of the box.

According to the aspect of the present invention set forth in Claim 3, not only the effects of the aspect of the present invention set forth in Claim 1 are provided but it is also possible to end the injection of the fluid by detecting that the top surface of the box has been inflated. Consequently, the amount of fluid injected can be optimized.

DETAILED DESCRIPTION OF THE PREFERRED EMBODIMENTS

Figure 1:
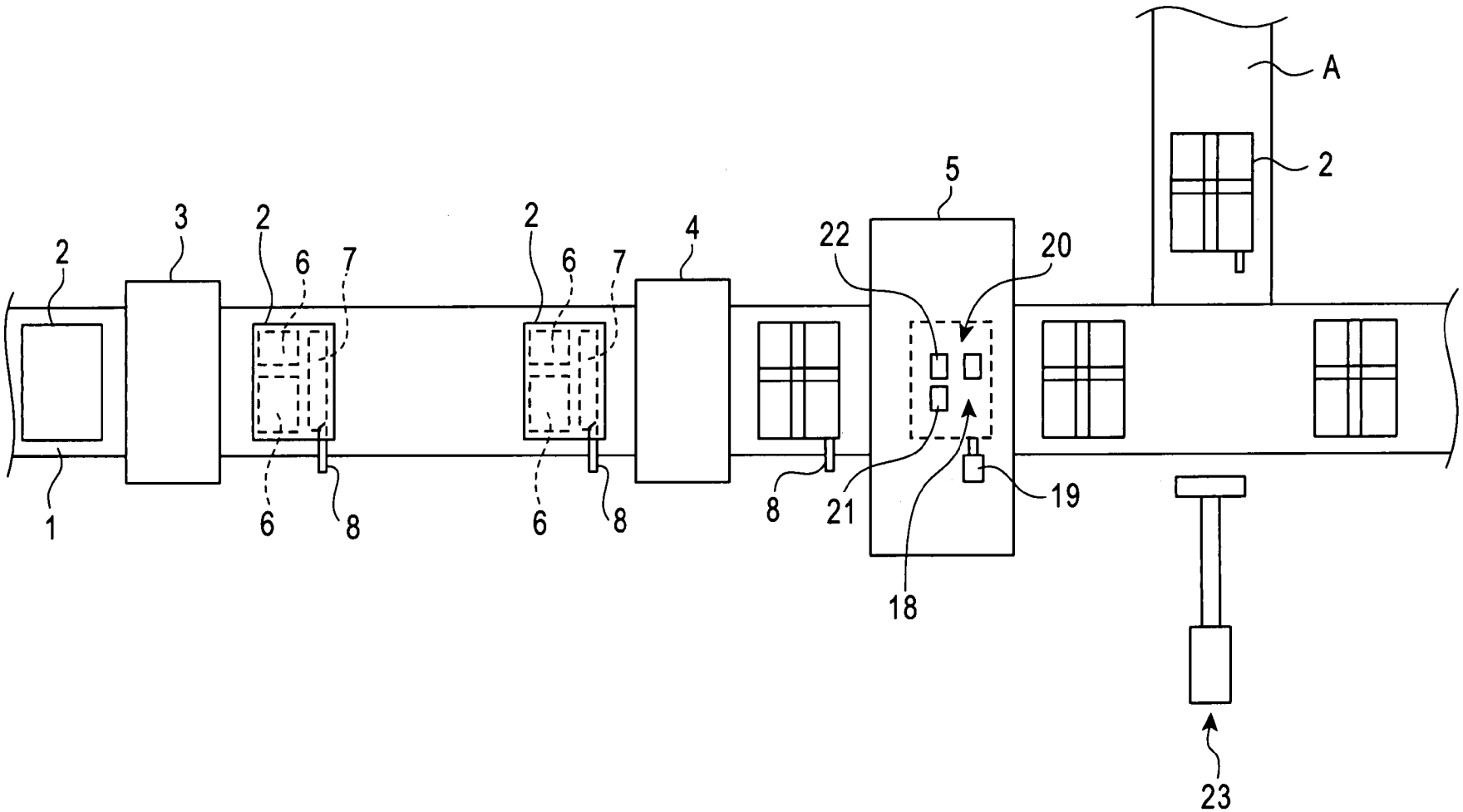
FIG. 1 is a schematic diagram of the present invention (embodiment of the present invention).

The entire configuration of a fluid injecting system will be described with reference to FIG. 1. In this figure, 1 is a conveying line. The conveying line 1 is composed of a belt conveyor or the like, and the conveying line 1 conveys a packing box 2 from upstream to downstream (in the drawing, from left to right).

An article loading station 3, a banding station 4, and a fluid injecting station 5 are arranged at intervals on the conveying line 1 from upstream to downstream.

Figure 2:
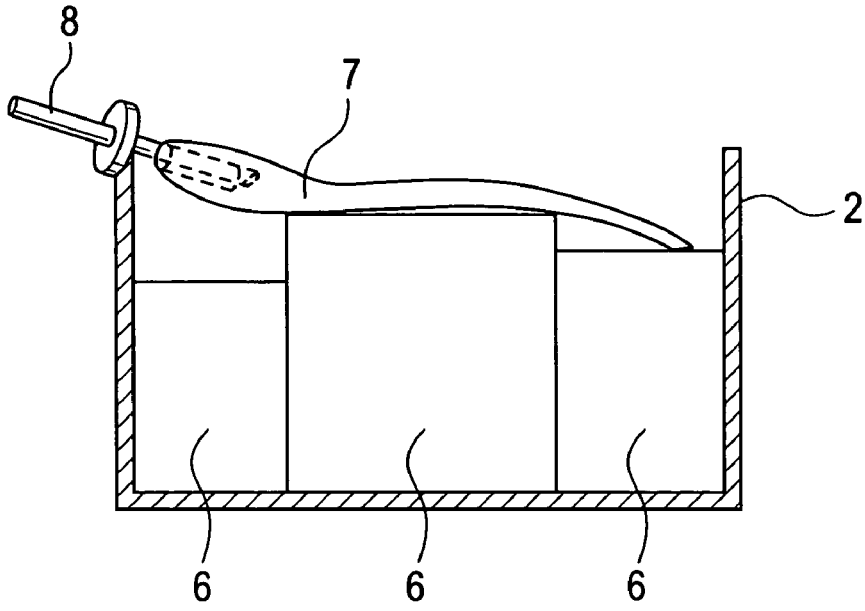
FIG. 2 is a sectional view of a box showing its inside (embodiment of the present invention).

An empty box 2 is conveyed from upstream of the article loading station 3 toward the article loading station 3. As shown in FIG. 2, in the article loading station 3, an article 6 is loaded into the packing box 2, and a deflated air bag 7 is placed on the article 6. A nozzle 8 having a check valve is installed in the air bag 7. The nozzle 8 is set so as to project out of the box 2.

Figure 3:
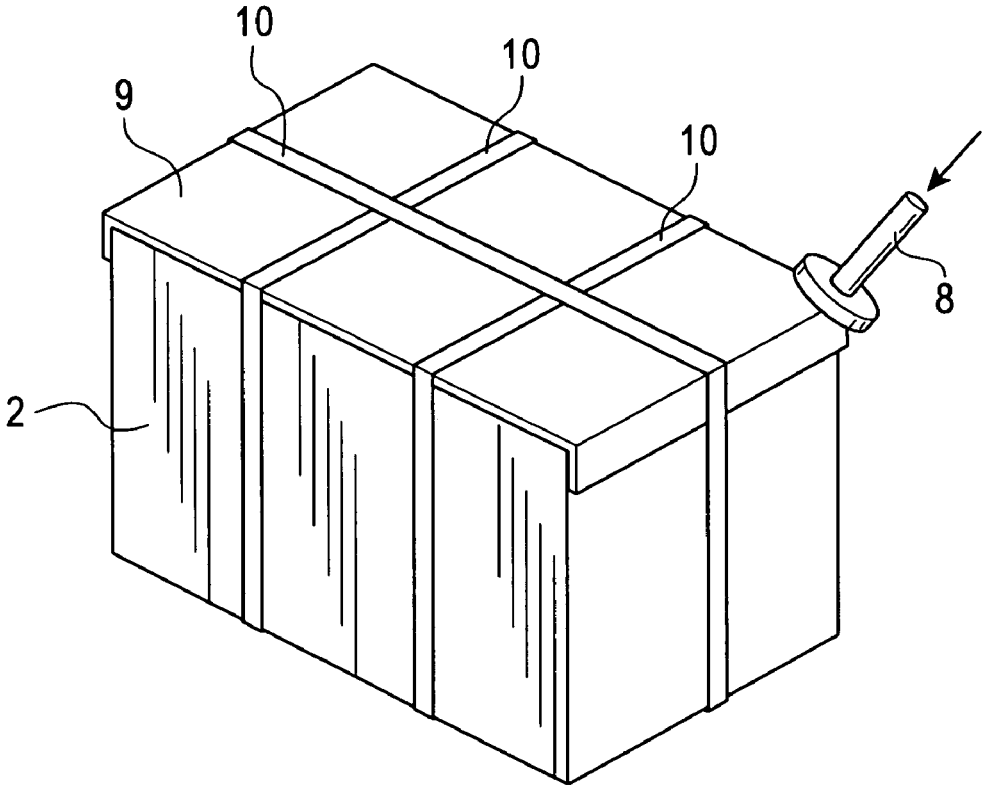
FIG. 3 is a diagram showing the appearance of the banded box (embodiment of the present invention).

As shown in FIG. 3, in the banding station 4, a cover 9 is placed on the packing box 2, and then, an outer periphery of the box 2 is tied with a band 10. The banding station 4 is provided with a cover setting device (not shown in the drawings) that automatically places the cover 9 on the box 2 and a banding device (not shown in the drawings) that automatically winds the band 10 around the outer periphery of the box 2.

In the fluid injecting station 5, a fluid is injected into the air bag 7 in the box 2 through the nozzle 8 projects out of the box 2 to inflate the air bag 7. This allows the air bag 7 to function as a cushioning material for the article in the box 2.

As shown in FIG. 1, the fluid injecting device 5 is provided with a nozzle presence detecting means 18 for detecting whether or not the nozzle 8 is attached to the box 2. The nozzle presence detecting means 18 detects whether or not the nozzle 8 is present in the box 2 conveyed from upstream. The nozzle presence detecting means 18 can also detect whether or not the nozzle 8 remains in the box 2 instead of being removed as described below after a fluid has been completely injected into the air bag 7. The specific configuration of the nozzle presence detecting means 18 will be described later.

Further, as shown in FIG. 1, the fluid injecting station 5 is provided with nozzle height position detecting means 20. The nozzle height position detecting means 20 can detect a top surface of the box 2, that is, the height position of the top surface of the box 2, to which the nozzle 8 is attached.

Figure 4:
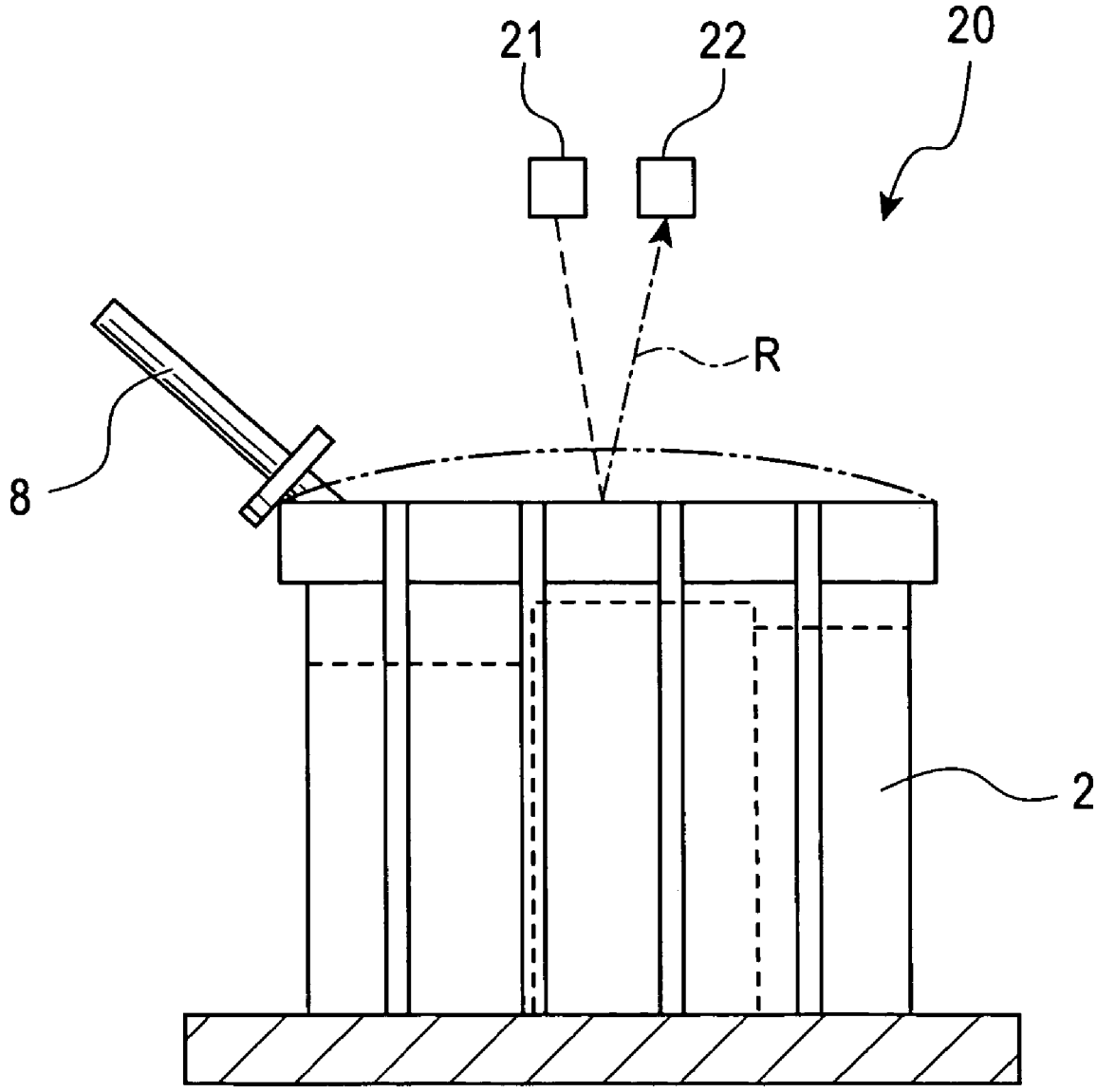
FIG. 4 is a diagram showing nozzle height position detecting means (embodiment of the present invention).

As shown in FIG. 4, the nozzle height position detecting means 20 can be composed of a light emitting portion 21 and a light receiving portion 22. The light emitting portion 21 and the light receiving portion 22 are provided above the center of box 2 as shown in FIG. 4. The light emitting portion 21 emits a laser beam R to the top surface of the box 2. The light receiving portion 22 then receives the laser beam R reflected by the box 2. Then, by measuring the amount of time after the light emitting portion 21 outputs the laser beam R and before the light receiving portion 22 receives the laser beam R, it is possible to measure the distance from the nozzle height position detecting means 20 to the nozzle 8.

Further, the nozzle height position detecting means 20 can detect that the air bag 7 is filled with a fluid. That is, as the fluid is filled into the air bag 7, the top surface of the bag 2 is pushed up by the air bag 7 as shown by an alternate long and two short dashes line in FIG. 4. This reduces the length of optical path of the laser beam R, thus making it possible to detect that the air bag 8 is being filled with the fluid. If the optical path length changes by a predetermined amount, the supply of air from the air supply portion 19 to the nozzle 8 is ended. The nozzle height position detecting means 20 preferably detects the central portion of the top surface of the box 2. Accordingly, the position of the nozzle height position detecting means 20 may be varied depending on the amount by which biasing means (not shown in the drawings) for biasing the box 2 toward one side of the conveying line 1. Alternatively, a diffusion type photoelectric sensor or the like may be attached to an elevating and lowering portion, and then, the height position of the nozzle 8 (top surface of the box 2) may be detected by elevating or lowering the diffusion type photoelectric sensor. On the other hand, the top surface of the box 2 may not be raised even after a predetermined time has passed since the start of injection of the fluid into the air bag 7. This makes it impossible to detect that the fluid is filled into the air bag 7. In this case, a disadvantage such as a hole accidentally formed in the air bag 7 can be detected.

As shown in FIG. 1, drive-away means 23 is provided downstream of the fluid injecting station 5. The drive-away means 23 is a device that drives away a box 2 corresponding to an error to a drive-away line A that is different from the regular conveying line 1.

That is, if the detection executed by the nozzle presence detecting means 18 indicates that the nozzle 8 has not been attached to the box 2 conveyed from upstream, the drive-away means 23 determines this to be an error and pushes out and drives away the box 2 to the drive-away line A. Further, if the detection executed by the nozzle height position detecting means 20 indicates that the air bag 7 has not been filled in spite of a predetermined flow of fluid injected into the air bag 7, the drive-away means 23 determines this to be an error and pushes out and drives away the box 2 to the drive-away line A. Moreover, if the detection executed by the nozzle presence detecting means 18 indicates that after the fluid is filled into the air bag 7, the nozzle 8, which would otherwise have been removed from the box 2, remains in the box 2, the drive-away means 23 determines this to be an error and pushes out and drives away the box 2 to the drive-away line A.

Figure 5:
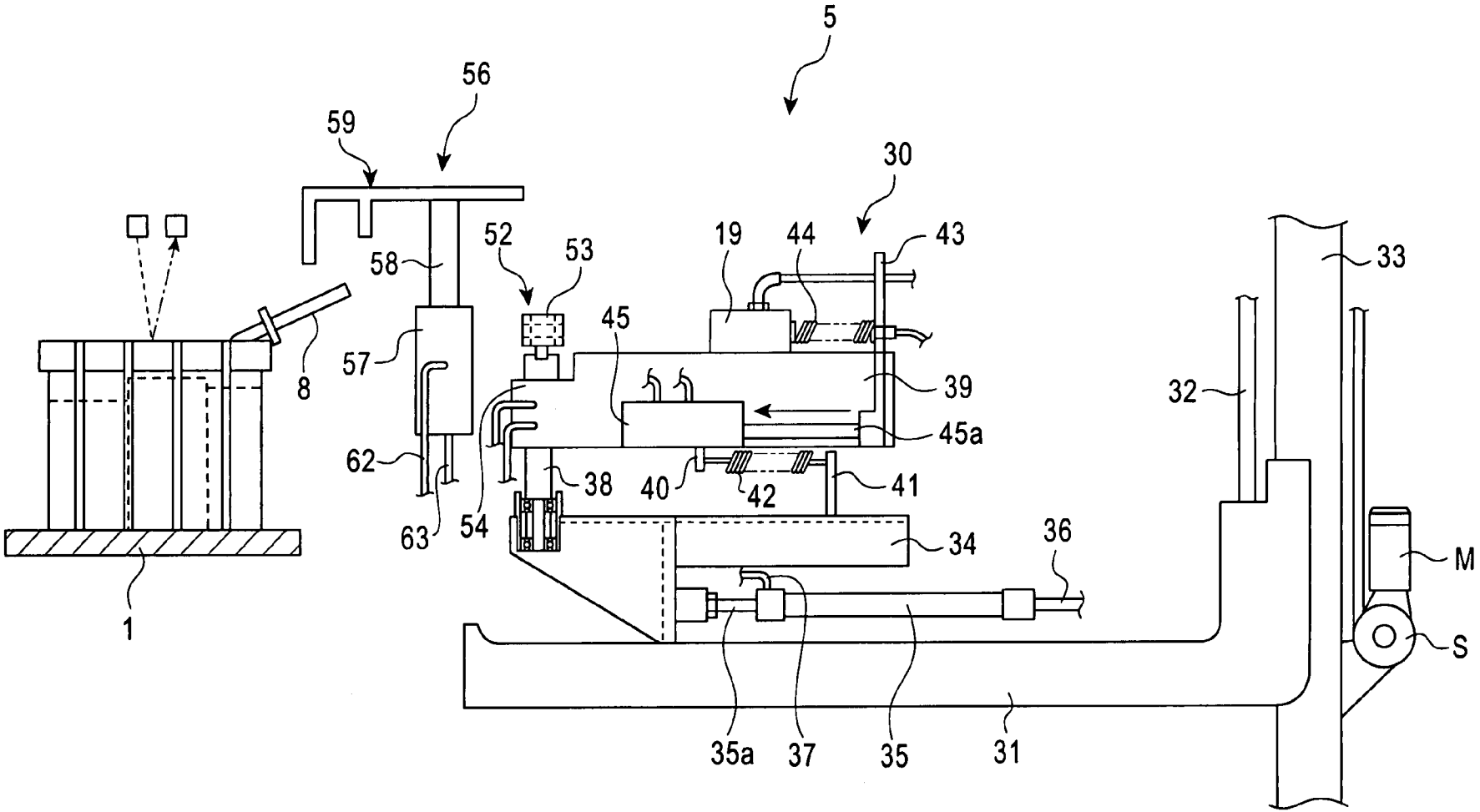
FIG. 5 is a diagram showing the configuration of a fluid injecting device (embodiment of the present invention).

Now, with reference to FIGS. 5 to 10, a description will be given of the configuration of a fluid injecting device 30 provided in the fluid injecting station 5. In FIG. 5, 31 is an elevating and lowering portion, and the elevating and lowering portion 31 can be elevated and lowered by, for example, a motor M. When the elevating and lowering portion 31 is thus elevated and lowered by the motor M, one end of a chain 32 or the like is attached to the elevating and lowering portion 31. The other end of the chain 32 is wound around a driving sprocket S via a sprocket (not shown in the drawings) provided at the top of a fixed portion 33. The driving sprocket S is rotatively driven by the motor M. The elevation and lowering of the elevating and lowering portion 31 is controlled by regulating power supplied to the motor M in accordance with the detected height position of the nozzle 8 on the basis of the detection executed by the nozzle height position detecting means 20. Control means according to Claim 1 is composed of the motor M, the driving sprocket S, and the chain 32.

A base portion 34 is provided with the elevating and lowering portion 31. The base portion 34 is attached to a cylinder rod 35*a* of a cylinder 35 fixed to the elevating and lowering portion 31. The cylinder rod 35*a* is placed so as to approach the conveying line 1 from a direction perpendicular to the conveying line 1 when expanded and to leave the conveying line 1 when contracted. The cylinder 35 is connected to an air supply/discharge switching portion (not shown in the drawings) through supply/discharge tubes 36, 37.

Accordingly, the base portion 34 operates to approach or leave the conveying line 1 as the cylinder 35*a* is expanded or contracted.

A pivotal shaft 38 is provided upright from the base portion 34. A movable frame 39 is rotatably attached to the pivotal shaft 38. When the nozzle 8 is gripped, the movable frame 39 follows the nozzle 8. A projection 40 is provided on a bottom surface of the movable frame 39. Further, a projection 41 is provided on a top surface of the base portion 34. The opposite ends of a spring 42 are attached to the respective projections 40, 41. Thus, the force of the spring 42 prevents the movable frame 34 from moving rotatively around the pivotal shaft 38 except when the nozzle 8 is gripped.

As shown in FIG. 5, the air supply portion 19, shown in FIG. 1, is provided on a top surface of the movable frame 39. A spring 44 is provided between a rear end of the air supply portion 19 and a movable plate 43. Further, a cylinder rod 45*a* of a cylinder 45 is attached to the movable plate 43. Accordingly, when air is supplied to or discharged from the cylinder 45 to expand or contract the cylinder rod 45*a*, the movable plate 43 and the air supply portion 19 slide. As the movable plate 43 slides, the air supply portion 19 approaches or leaves the nozzle 8.

Figure 6:
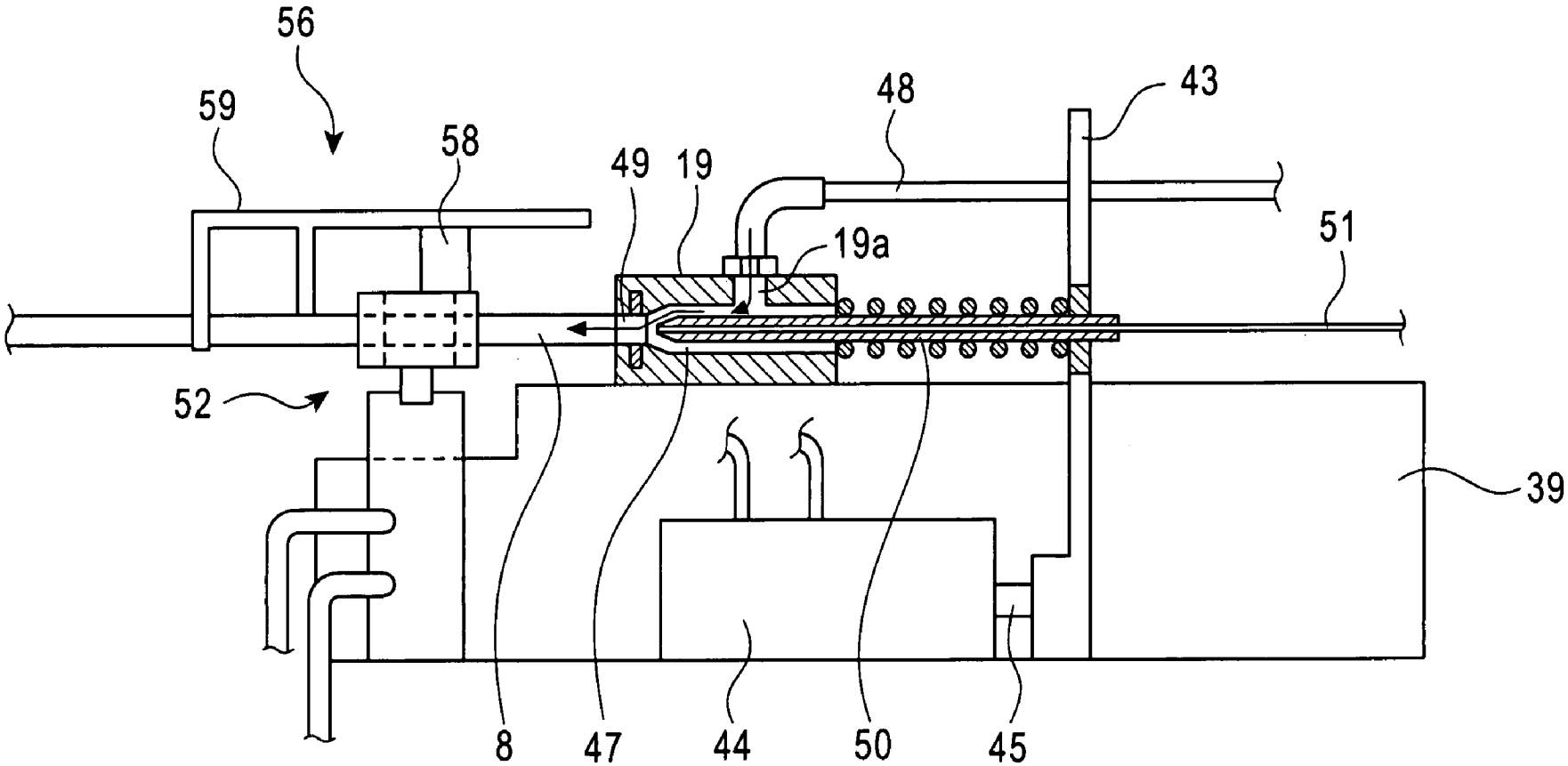
FIG. 6 is a diagram partly showing the configuration of the fluid injecting device (embodiment of the present invention).

As shown in FIG. 6, a through-hole 47 is formed in the center of the air supply portion 19, and a hole 19*a* is also formed in a side surface of the air supply portion 19, and an air supply tube 48 is connected to the hole 19*a*. The tip of the through-hole 47 constitutes an air supply port 49, and the air supply port 49 can be connected to the nozzle 8 to supply air to the nozzle 8. The air supply portion 19 releases air supplied through the air supply tube 48, to the nozzle 8. through the through-hole 47 in the air supply portion 19. Further, a vent pipe 50 is slidably inserted into the through-hole 47 in the air supply portion 19. A tube 51 is connected to the vent pipe 50.

The vent pipe 50 is used to detect the air pressure at the tip of the air supply portion 19. When the value of the air pressure at the tip of the air supply portion 19 becomes equal to or larger than a predetermined threshold, the supply of air to the air supply portion 19 is stopped. That is, when the air bag 7 is supplied with and becomes full of air or if the supply of air to the air bag 7 is inhibited, the supplied air flows backwards through the vent pipe 50. Thus, when air flows through the vent pipe 50 and the backward flow pressure reaches the threshold, the supply of air to the air supply portion 19 is stopped. As a result, the supply of air to the nozzle 8 is stopped. In the present embodiment, in addition to the nozzle height position detecting means 20, the vent pipe 50 is used to detect the air pressure. However, the detection can be achieved using only the nozzle height position detecting means 20.

Figure 8:
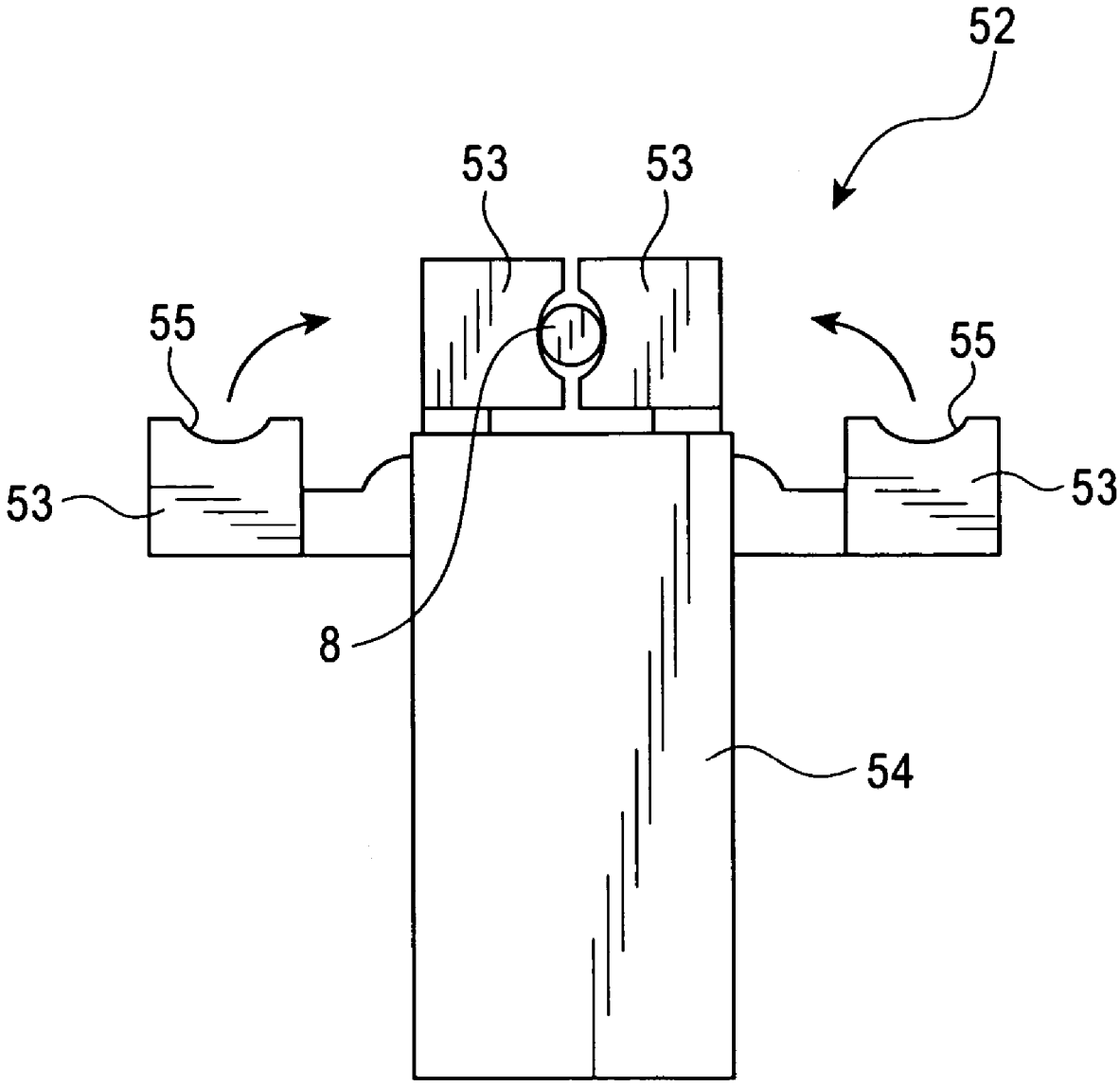
FIG. 8 is a front view of an operation of a gripping device (embodiment of the present invention).

As shown in FIG. 5, the movable frame 39 is provided with a gripping device 52. FIG. 8 is a front view of the gripping device 52. The gripping device 52 comprises gripping portions 53, 53 and a cylinder 54 that drives the gripping portions 53, 53. The gripping portions 53, 53 are devices that grip the nozzle 8 by being closed or opened when air is supplied to or discharged from the cylinder 54. A semicircular concave portion 55 is formed on each of the opposite surfaces of the gripping portions 53, 53. When the gripping portions 53, 53 grip the nozzle 8, the nozzle 8 can be appropriately gripped so that the two concave portions 55, 55 sandwich the nozzle 8 between them.

Figure 7:
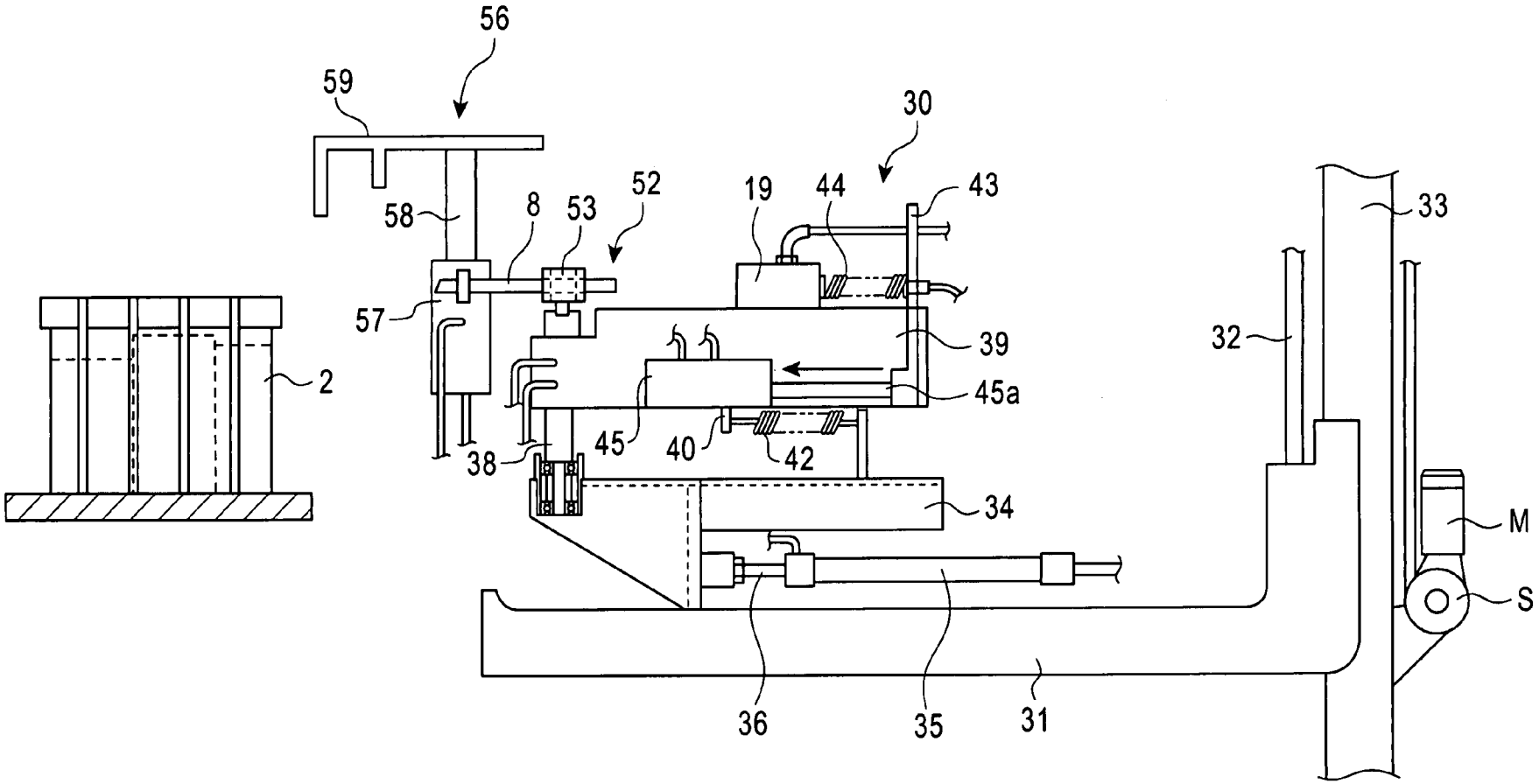
FIG. 7 is a diagram showing the configuration of the fluid injecting device (embodiment of the present invention).

The gripping device 52 grips the nozzle 8 when a fluid is injected into the air bag 7 as shown in FIG. 6. Further, once the injection of the fluid into the air bag 7 is completed, the gripping device 52 leaves the air bag 7 while keeping gripping the nozzle 8 as shown in FIG. 7.

As shown in FIGS. 1 and 8, the gripping device 52 is provided with the nozzle presence detecting means 18. The nozzle presence detecting means 18 is composed of a photoelectric switch, and so on. The nozzle presence detecting means 18 can detect whether or not the gripping device 52 has gripped the nozzle 8.

Consequently, when the nozzle presence detecting means 18 does not detect the presence of the nozzle 8, which would otherwise be gripped by the gripping portions 53 in order to inject the fluid into the air bag 7 as shown in FIG. 6, it is possible to detect that the nozzle 8 has not been attached to the box 2 conveyed from upstream. Further, a fluid has been completely injected into the air bag 7, and when the nozzle presence detecting means 18 does not detect the presence of the nozzle 8, which would otherwise be kept gripped by the gripping device 52 leaving the air bag 7 as shown in FIG. 7, it is possible to detect that the nozzle 8 remains attached to the box 2, that is, the nozzle 8 remains in the box 2 instead of being removed.

Figure 9:
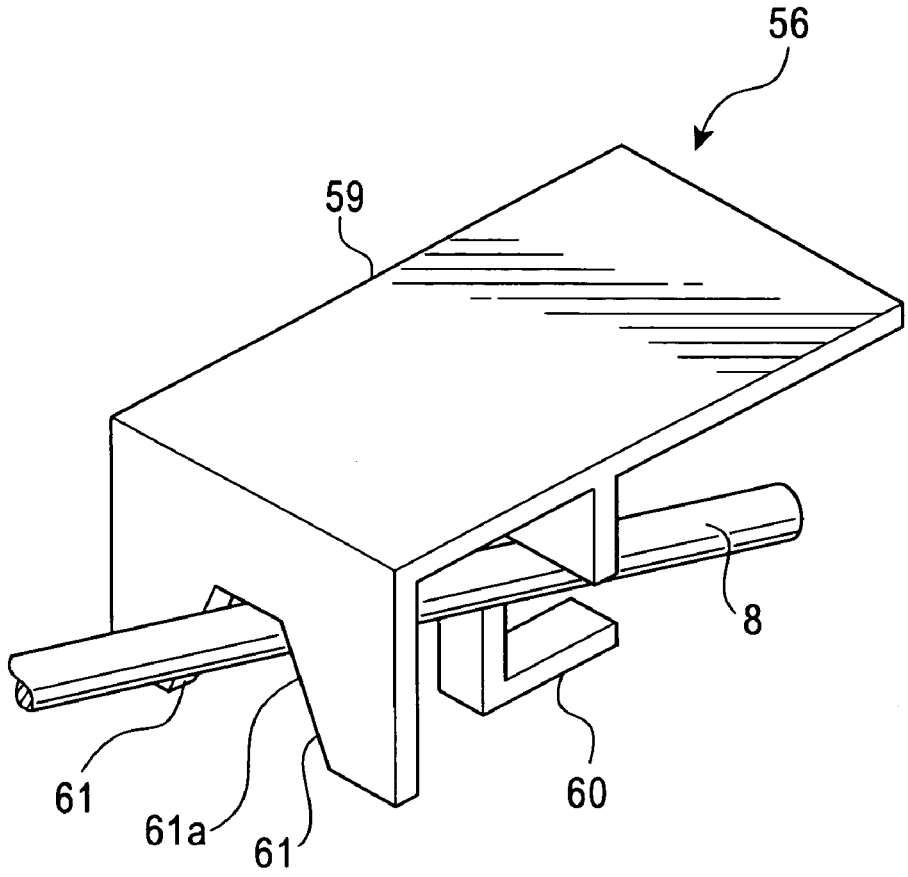
FIG. 9 is a perspective view of a presser member and a receiving member (embodiment of the present invention).
Figure 10:
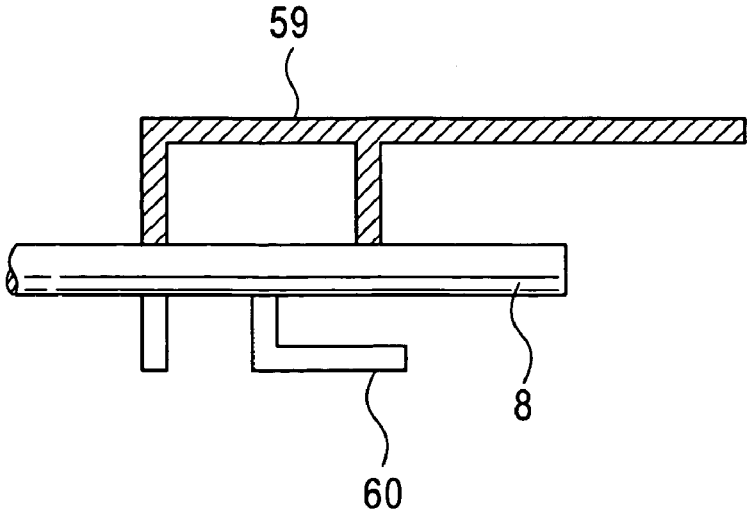
FIG. 10 is a sectional view of FIG. 9 (embodiment of the present invention).

In FIG. 5, 56 is horizontal positioning means. The horizontal positioning means 56 holds a projecting end side of the nozzle 8, which projects from the box 2, horizontally so as to sandwich the projecting end side of the nozzle 8 between its upper and lower parts to position the nozzle 8 horizontally. The horizontal positioning means 56 is composed of a cylinder 57 extending in a vertical direction, a presser member 59 attached to a cylinder rod 58 of the cylinder 57, and a receiving member 60 provided opposite the presser member 59 as shown in FIGS. 9 and 10. The receiving member 60 supports the nozzle 8 at one point from below. On the other hand, the presser member 59 presses the nozzle 8 at two points so as to stride the receiving member 60. A tapered surface is formed on the presser member 59 to regulate the lateral position of the nozzle 8. In the horizontal positioning means configured as described above, with its lateral movement regulated by tapered surfaces 61, 61, the nozzle 8 is sandwiched between the presser member 59, located above, and the receiving member 60, located below, at three points. The nozzle 8 is thus appropriately positioned. In the above description, the receiving member 60 is provided below the nozzle 8, while the presser member 59 is provided above the nozzle 8. However, the receiving member 60 is provided above the nozzle 8, while the presser member 59 may be provided below the nozzle 8.

Now, the operation of the present invention will be described. As shown in FIG. 1, the empty packing box 2 is conveyed from upstream of the conveying line 1. When the box 2 reaches the article loading station 3, the desired article 6 is loaded into the box 2. Further, the deflated air bag 7 is placed on the article 6. Moreover, the nozzle 8 is installed on the air bag 7.

Then, the box 2 is conveyed to the banding station 4, located downstream. In the banding station 4, as shown in FIG. 3, the cover 9 is placed on the box 2 to close it. Then, the outer periphery of the box 2 is tied with the band 10.

Then, in the fluid injecting station 5, as shown in FIG. 5, the nozzle height position detecting means 20 detects the top surface of the box 2, that is, the height position of the nozzle 8. The height position of the elevating and lowering portion 31 is adjusted on the basis of the detection executed by the height position detecting means 20 to align the height position of the air supply portion 19 with the height position of the nozzle 8.

Subsequently, as shown in FIG. 5, the cylinder rod 35*a* of the cylinder 35 is extended to move the base portion 34 closer to the nozzle 8. Air is supplied to or discharged from the cylinder 57 of the horizontal positioning means 56 to contract the cylinder rod 58. The presser member 59 is thus lowered to press the nozzle 8 from above. In this case, as shown in FIGS. 9 and 10, the nozzle 8 is pressed at three points by the presser member 59 and the receiving member 60, and is thus positioned horizontally.

Then, as shown in FIG. 8, the cylinder 54 is actuated to allow the gripping portions 53, 53 to grip the nozzle 8. Then, as shown in FIG. 6, the cylinder rod 45*a* of the cylinder 45 is contracted to connect the air supply portion 19 to the nozzle 8.

Then, the air supply portion 19 supplies air, which then flows through the nozzle 8 to inflate the air bag 7.

Then, when the nozzle height position detecting means 20, shown in FIG. 1 or FIG. 4, detects that the top surface of the box 2 has been inflated, that is, that the air bag 8 is full of the fluid, the supply of air from the air supply portion 19 to the nozzle 8 is stopped. This in turn stops the injection of the fluid into the air bag 7.

Then, in the state shown in FIG. 6, the cylinder rod 45*a* of the cylinder 45 is extended to separate the air supply portion 19 from the nozzle 8. Subsequently, as shown in FIG. 7, the cylinder rod 58 of the cylinder 57 is extended upward to separate the presser member 59 of the horizontal positioning member 56 from the nozzle 8. Then, as shown in FIG. 7, the cylinder rod 36 of the cylinder 35 is contracted. The base portion 34 is then separated from the box 2 with the gripping device 52 keeping gripping the nozzle 8. That is, the nozzle 8 can be removed from the air bag 7. In this state, the gripping device 52 is opened to drop the nozzle 8 into a recovery box. Thus, the process of injecting the fluid into the air bag 7 is completed. Nozzle removing means removes the nozzle 8 from the air bag 7 after the fluid has been injected into the air bag 7. The nozzle removing means is composed of the cylinder 35, the base portion 34, the movable frame 39, and the gripping device 52 as shown in FIG. 7.

On the other hand, if the nozzle 8 cannot be removed from the air bag 7 as shown in FIG. 7, the nozzle presence detecting means 18 of the gripping device 52 does not detect the presence of the nozzle 8. In this case, the nozzle 8 remains in the air bag 7. Consequently, the drive-away means 23, shown in FIG. 1, drives the box 2 in which the nozzle 8 remains, away to the drive-away line A so as to push it out.

Figure 11:
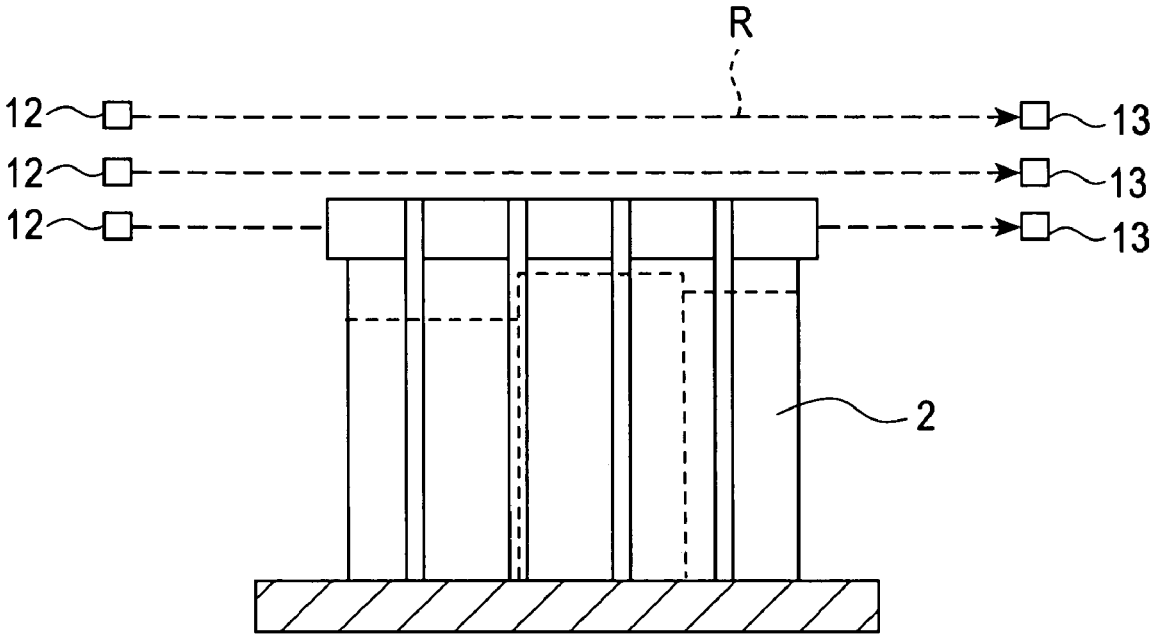
FIG. 11 is a diagram showing a variation of the nozzle height position detecting means (embodiment of the present invention).

In the above description, as shown in FIG. 4, the nozzle height position detecting means 20 is composed of the light emitting portion 21, located above the center of the box 2, and the light receiving portion 22. However, as shown in FIG. 11, plural sets of a light emitting portion 12 and a light receiving portion 13 may be arranged in a vertical direction so that the height position of the top surface of the box 2, that is, the height position of the nozzle 8 can be detected by the light emitting portion 12 and the light receiving portion 13 corresponding to the position where the box 2 blocks the beam R.

Figure 12:
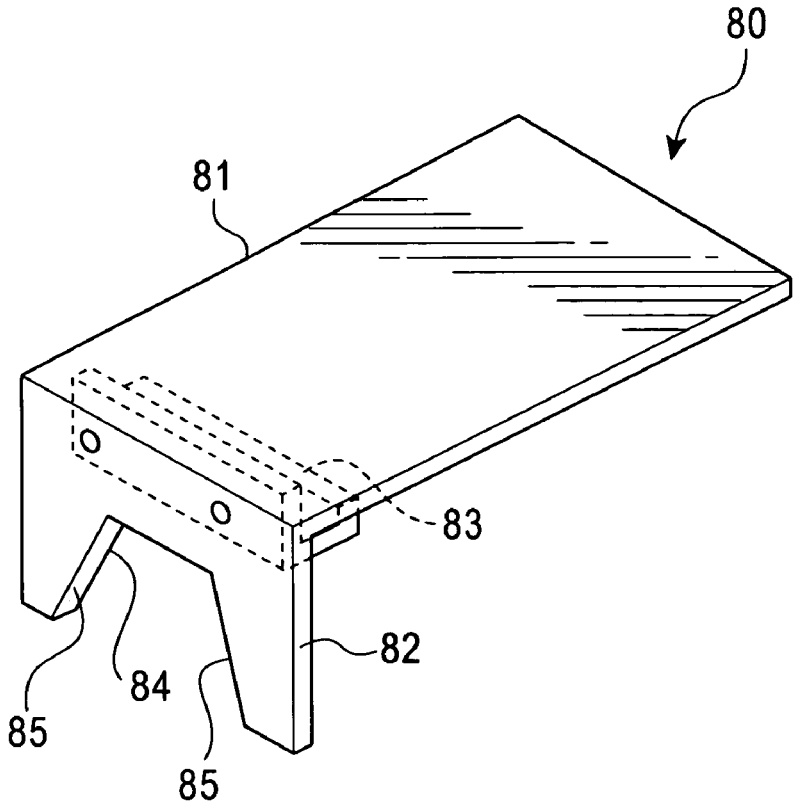
FIG. 12 is a perspective view of a variation of the presser member (embodiment of the present invention).
Figure 13:
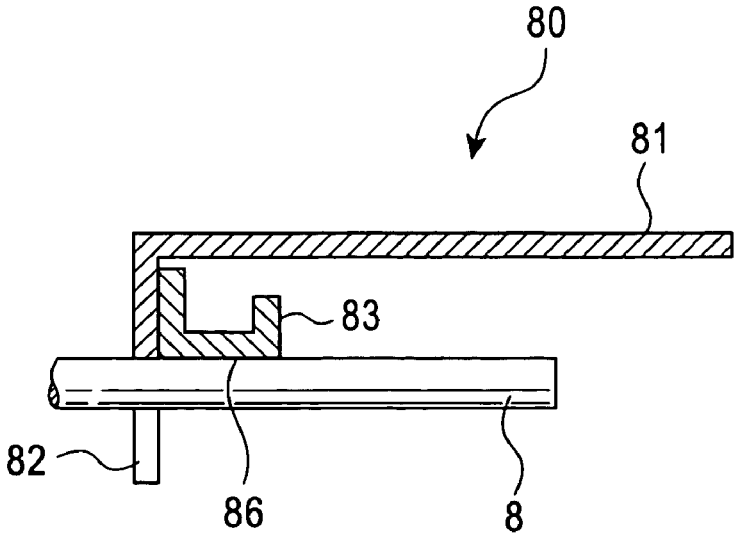
FIG. 13 is a side view of FIG. 12 (embodiment of the present invention).
Figure 14:
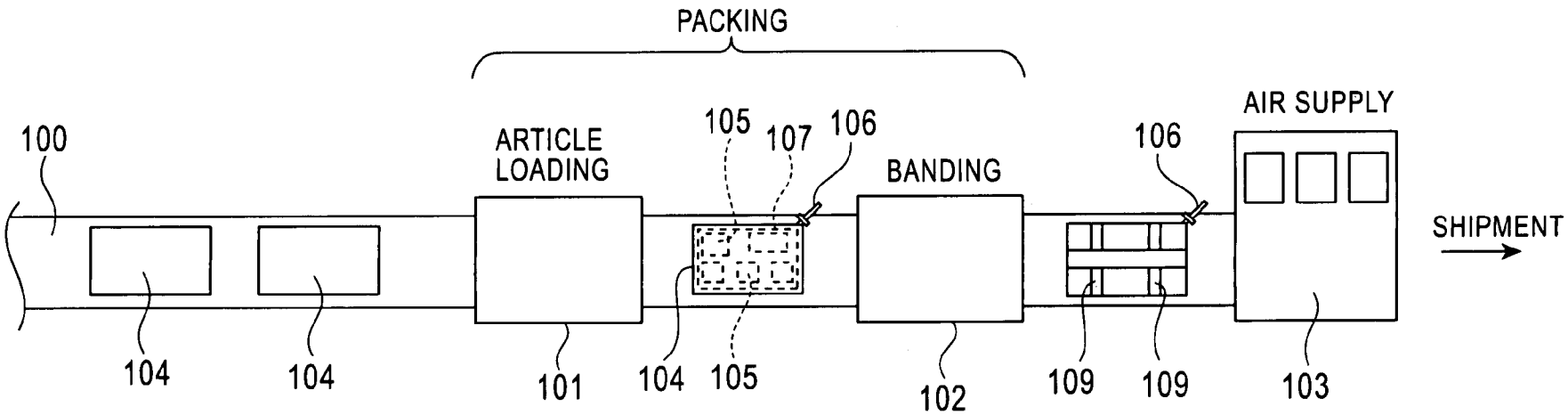
FIG. 14 is a schematic diagram of the configuration of a prior art fluid injecting device (prior art).
Figure 15:
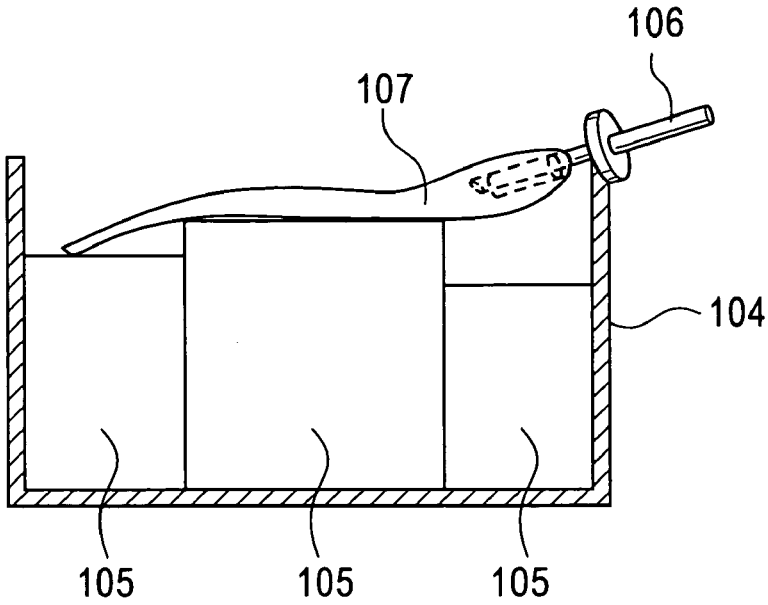
FIG. 15 is a sectional view of a box in which an article and an air bag are accommodated (prior art).
Figure 16:
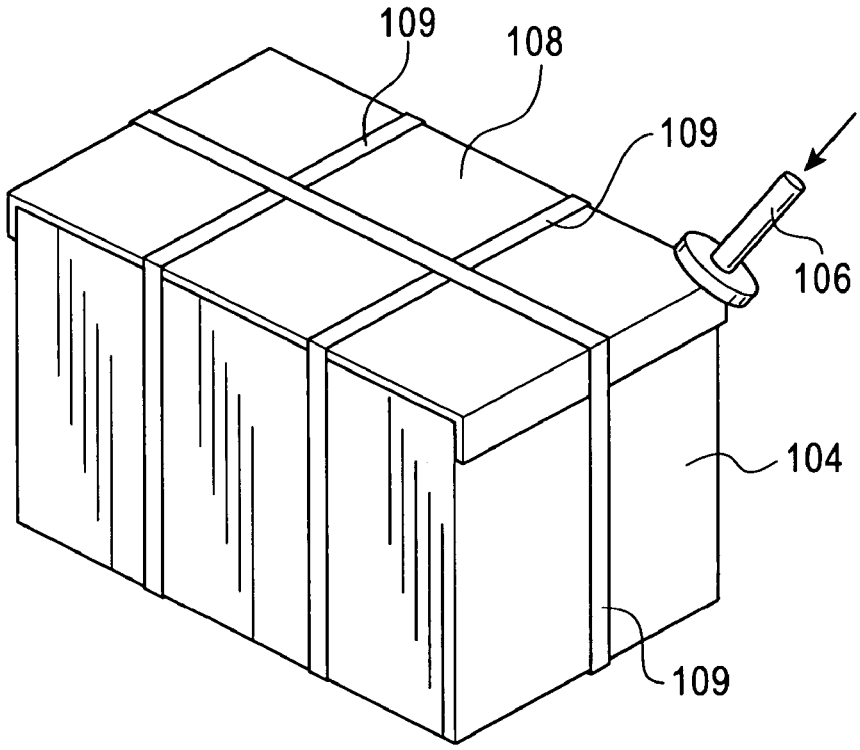
FIG. 16 is a perspective view of the box (prior art)

FIGS. 12 and 13 show a variation of the presser member 59 of the horizontal positioning means 56. A presser member 80 comprises an attachment portion 81 attached to the tip of the cylinder rod 58 as shown in FIG. 6, a presser piece 82 folded downward from the tip of the attachment portion 81, and an auxiliary presser piece 83 provided inside the presser piece 82. A presser groove 84 has a pair of tapered surfaces 85, 85 that fans out downward. Further, the auxiliary presser piece 83 has a horizontal auxiliary presser portion 86 extending straight in the horizontal direction. The auxiliary presser piece 83 is generally L-shaped.

In the presser member 59 formed as described above, as shown in FIG. 12, the tapered surfaces 85, 85 of the presser portion 81 guide the nozzle 8 to the bottom of the presser groove 84. The horizontal auxiliary presser portion 86 of the auxiliary presser piece 83 positions the nozzle 8 horizontally so that the surfaces press the nozzle 8 downward.

The invention claimed is:

1. A fluid injecting device that injects a fluid into an air bag through a nozzle projecting from a box, the air bag being housed in a box, the fluid injecting device comprising:

a nozzle height position detection means for detecting a height position of the nozzle by detecting a top surface of the box; and a control means for varying the height position of said fluid injecting device in accordance with the height position of the nozzle detected by the detection means, wherein said nozzle height position detection means is capable of detecting the injection of the fluid into the air bag, and said nozzle height position detection means comprises a light emitting portion and a light receiving portion provided above the center of said box.

2. The fluid injecting device according to claim 1, wherein said nozzle height position detecting means detects a top surface of the box.

3. The fluid injecting device according to claim 2, wherein the injection of the fluid is stopped in accordance with the detection carried out by said sensor.

* * * * *